US006997513B2

(12) United States Patent
Ige et al.

(10) Patent No.: US 6,997,513 B2
(45) Date of Patent: Feb. 14, 2006

(54) CHAIR FOR HEALTHY SITTING

(75) Inventors: Leighton Makoto Ige, Needham, MA (US); Charles Yoshio Saiki, Aiea, HI (US)

(73) Assignee: Salubrion LLC, Framingham, MA (US)

( * ) Notice: Subject to any disclaimer, the term of this patent is extended or adjusted under 35 U.S.C. 154(b) by 0 days.

(21) Appl. No.: 10/706,022

(22) Filed: Nov. 12, 2003

(65) Prior Publication Data

US 2005/0099053 A1 May 12, 2005

Related U.S. Application Data

(60) Provisional application No. 60/494,881, filed on Aug. 13, 2003.

(51) Int. Cl.
*A47C 9/00* (2006.01)

(52) U.S. Cl. ..... 297/445.1; 297/411.41; 297/440.12; 297/451.12; 248/174

(58) Field of Classification Search ..... 297/411.41, 297/440.12, 445.1, 451.12; 248/174
See application file for complete search history.

(56) References Cited

U.S. PATENT DOCUMENTS 422,660 A * 3/1890 Thorkelson ..... 297/411.41
2,541,835 A * 2/1951 Saarinen ..... 297/411.41
D184,371 S * 2/1959 Radke ..... D6/356
D193,338 S * 8/1962 Tepper ..... D6/375
3,142,514 A * 7/1964 Ginat ..... 297/451.3
D260,334 S * 8/1981 Van Horn ..... D6/375
4,390,204 A * 6/1983 Fleishman ..... 248/174
5,317,765 A * 6/1994 Knoedler et al. ..... 297/411.4
5,876,098 A 3/1999 Conaway et al.
D422,804 S * 4/2000 Tarlow ..... D6/369
D436,749 S * 1/2001 Arad ..... D6/374

* cited by examiner

*Primary Examiner*—Peter R. Brown
(74) *Attorney, Agent, or Firm*—Ward & Olivo

(57) ABSTRACT

Disclosed is a supportive chair for sitting comfortably at low heights above and relative to the ground. Preferably, the chair comprises a primary seating surface and a secondary seating surface curving around the rear of the primary seating surface to provide additional support for the user. It is preferred that the secondary seating surface be inwardly and downwardly sloped and provide a low lateral boundary for the user, thereby promoting proper alignment of the buttocks on the primary seating surface. Thus, the chair raises the buttocks and hips of the user off of the seating level, creating a relative height difference between the hips and legs. This raising of the hips relative to the legs creates a sitting posture that promotes vertical back alignment. As a result, the user is able to comfortably maintain this position with a reduced amount of back muscle strain, allowing prolonged comfortable seating periods.

15 Claims, 3 Drawing Sheets

CHAIR FOR HEALTHY SITTING

CROSS-REFERENCE TO RELATED APPLICATIONS

This application claims priority to provisional application no. 60/494,881, filed on Aug. 13, 2003.

FIELD OF THE INVENTION

The present invention relates to an apparatus for healthy and corrective sitting. In particular, the invention relates to a chair for meditative or conventional sitting that promotes correct back and lower body posture, which allows for greater comfort.

BACKGROUND OF THE INVENTION

In traditional forms of meditation there exist two major positions for sitting, the lotus position and the seiza position. In the lotus position (as shown in FIG. 6), the individuals legs are crossed and lay in front of the hips. Another position is known as the seiza position in which the individual kneels with his or her buttocks resting on the heels (as shown in FIG. 5). Due to muscle, bone or joint related complications, many individuals wishing to engage in meditation, especially beginners, find it difficult to sit in either pose for extended periods of time without developing pain or restricting circulation in the legs. Thus, many sitting aids such as chairs and cushions have been developed to assist the individual wishing to meditate using one of these conventional poses.

For example, low, cylindrical cushions filled with buckwheat have traditionally been used by individuals during meditation. A cushion about shoulder-width may be used to support an individual sitting in the lotus position, while a slightly smaller cushion may support a individual in the seiza position. However, over time the buckwheat deteriorates, reducing support. Additionally, these buckwheat cushions tend to be large, heavy, and somewhat cumbersome, impeding transportation and efficient storage.

More recently, dense foam and wooden blocks have been used to support individuals seated in the lotus position. These and other alternatives, such as low chairs, one of which is disclosed in Conway et al., U.S. Pat. No. 5,876,098, are limited to the lotus position and also difficult to transport due to their size.

Similarly, benches consisting of a horizontal platform wide enough to support the buttocks and raised from the ground by two vertical legs at opposite ends of the platform are used to assist the individual seated in the seiza position. This allows for proper vertical alignment by positioning the buttocks above the heels while eliminating the pressure caused by the individual's weight on the heels and lower legs. However, the height of such benches is typically too high from the ground due to the clearance required for the heels, causing excessive weight to be placed on the individual's knees. This causes discomfort in the knees during extended periods of meditation.

Other chairs also exist for sitting on the ground. Some of such chairs consist of a right-angled support that sits directly on the ground and is usually cushioned. However, these chairs do not provide a difference in elevation between the hips and legs, causing improper alignment of the back.

Therefore, there is a need for a chair which is portable and can be used in different configurations for either general sitting on the ground or meditation in the lotus or seiza positions, enabling the user to sit comfortably for extended periods of time. The present invention meets these needs.

OBJECTS OF THE INVENTION

In light of these apparent needs, it is an object of the present invention to provide a chair that promotes good posture, providing proper height of the hips as well as proper curve of the lower back.

It is an object of the present invention to provide a chair for meditation that may be used at different heights for either the lotus or seiza position.

It is an object of the present invention to provide a chair that prevents excessive pressure on the lower legs and heels of the user.

It is an object of the present invention to create a sitting position that is comfortable and maintainable for long durations of time.

It is an object of the present invention to create a chair that may be injection molded and produced economically.

It is an object of the present invention to create a chair that may be stackable.

It is an object of the present invention to create a chair that is aesthetically pleasing and may be used as a piece of accent furniture. Along these same lines, the invention is such that it is easy to manufacture in different colors, patterns, styles, materials, etc.

It is an object of the present invention to provide a lightweight, low profile chair that may be easily transported by an individual.

It is an object of the present invention to provide a chair that may be utilized on a stool or regular chair to promote proper posture in positions other than that of meditation.

It is an object of the present invention to provide a chair that may be used by children for sitting on the ground with proper posture. This chair would be scaled down in size in accordance with the size of the child.

It is an object of the present invention to provide a chair that may be used outdoors for activities including, but not limited to, sporting events, hunting, fishing, or camping.

It is an object of the present invention to provide a chair that may be used for individuals desiring to sit comfortably on the ground, floor, or desired seating level.

It is an object of the present invention to provide a chair which is collapsible and/or foldable (e.g., into a planar sheet) for easy storage and/or transport.

It is an object of the present invention to provide a chair as described with various leg configurations such that the legs may be extendable, collapsible, foldable, etc.

Other objects, features, and characteristics of the present invention, as well as the methods of operation and functions of the related elements of the structure, and the combination of parts and economies of manufacture, will become more apparent upon consideration of the following detailed description with reference to the accompanying drawings, all of which form a part of this specification.

SUMMARY OF THE INVENTION

The present invention relates to a supportive chair for individuals wishing to sit comfortably at a low height above and relative to the ground, floor, or desired seating level. Generally, the seat raises the buttocks and hip of the user off of the seating level, creating a relative height difference between the user's hip and legs. This raising of the hip relative to the legs creates a sitting posture that promotes vertical back alignment. The user's lower back is pushed into a slight forward curve, providing proper back posture. Consequently, the user is able to comfortably maintain this position with a reduced amount of back muscle strain, allowing prolonged comfortable seating periods.

Preferably, the chair according to the invention may be made at any of a multitude of heights relative to the ground, floor, or desired seating level to accommodate different size users and different desired methods of seating. Optionally, the chair may be configured such that the height is adjustable. This height may be varied by simply adjusting the length or position of the legs. For example, two major styles of meditative seating positions are supported by the invention. The lotus or cross-legged seating position is supported by a lower seat height. The seiza seating position, where the user's legs are folded over at the knee, locating the thigh over the calf, is enabled by a slightly higher seat height along with the unique design of the primary seating surface.

The special cutout design of the primary seating surface allows for the heels of the user to be tucked under the buttocks while seated in the seiza position. The curved back support along with the primary seating surface support the majority of the user's weight. This enables the individual to sit with no pressure being exerted on the heels from the buttocks. This cutout design also provides a convenient way to carry the chair.

The chair may also be made at different diameters to accommodate different sized users. Smaller chairs may be used by children in different venues such as the home or school to sit comfortably and with proper posture.

Optionally, the chair according to the present invention may include a cushion attached to the seating surface or surfaces to provide additional comfort, support and style.

The present invention may also be used on or as an addition to the seats of standard chairs to improve the posture and back alignment of the user. Proper hip elevation promotes the slight forward curve of the lower back required for comfortable, extended sitting.

Depending on the material used for manufacture, the present invention may or may not include supplementary structural supports connecting the primary and secondary seating surfaces.

BRIEF DESCRIPTION OF THE DRAWINGS

A further understanding of the present invention can be obtained by reference to a preferred embodiment set forth in the illustrations of the accompanying drawings. Although the illustrated embodiment is merely exemplary of systems for carrying out the present invention, both the organization and method of operation of the invention, in general, together with further objectives and advantages thereof, may be more easily understood by reference to the drawings and the following description. The drawings are not intended to limit the scope of this invention, which is set forth with particularity in the claims as appended or as subsequently amended, but merely to clarify and exemplify the invention.

For a more complete understanding of the present invention, reference is now made to the following drawings in which.

DETAILED DESCRIPTION OF A PREFERRED EMBODIMENT

As required, a detailed illustrative embodiment of the present invention is disclosed herein. However, techniques, systems and operating structures in accordance with the present invention may be embodied in a wide variety of forms and modes, some of which may be quite different from those in the disclosed embodiment. Consequently, the specific structural and functional details disclosed herein are merely representative, yet in that regard, they are deemed to afford the best embodiment for purposes of disclosure and to provide a basis for the claims herein which define the scope of the present invention. The following presents a detailed description of the preferred embodiment (as well as some alternative embodiments) of the present invention.

Referring first to FIGS. 1–4, depicted is the preferred embodiment of the chair according to the present invention. In the preferred embodiment of the present invention a chair 1 comprises a primary seating surface 2 that the user contacts which is horizontal or slightly angled relative to the ground or floor on which the chair is placed. A secondary seating surface 3 curving around the rear of the primary seating surface 2 provides additional support for the user's buttocks. The secondary seating surface 3 is inwardly and downwardly sloped and provides a low lateral boundary for the user, thereby promoting proper alignment of the buttocks on the primary seating surface 2.

Figure 1:
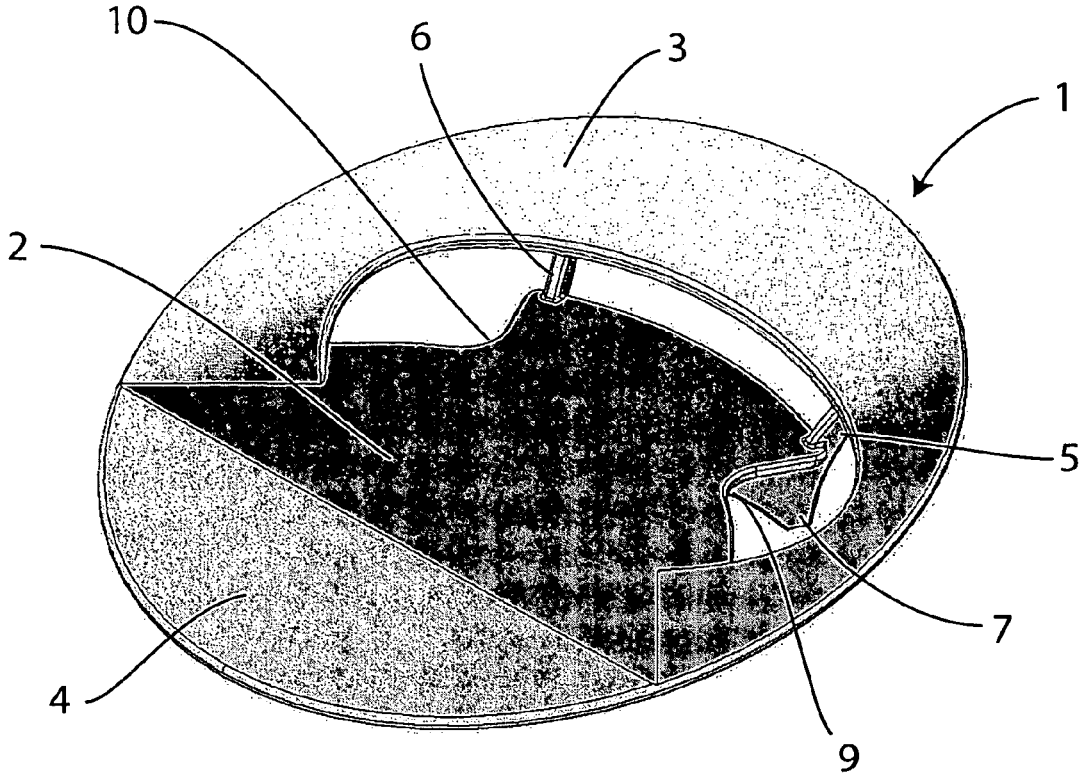
FIG. 1 shows a perspective view of the preferred embodiment of the chair according to the invention.
Figure 2:
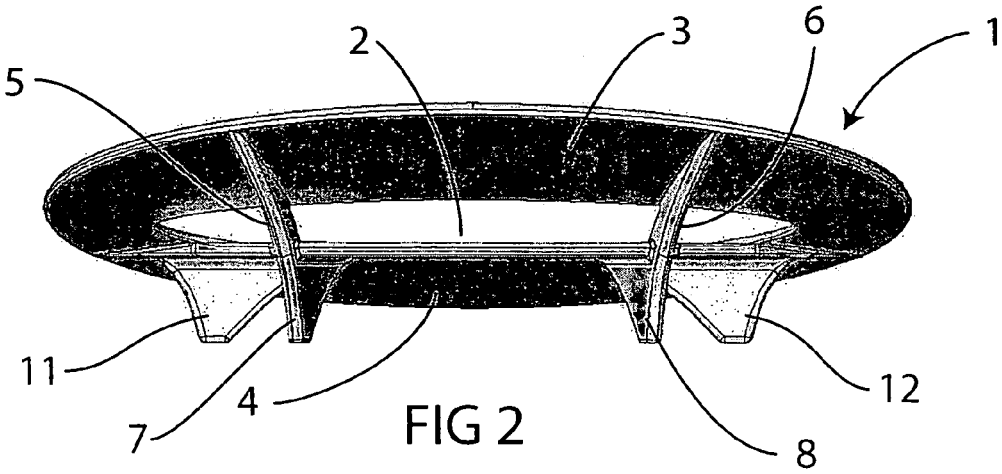
FIG. 2 shows a back view of the chair shown in FIG. 1.
Figure 3:
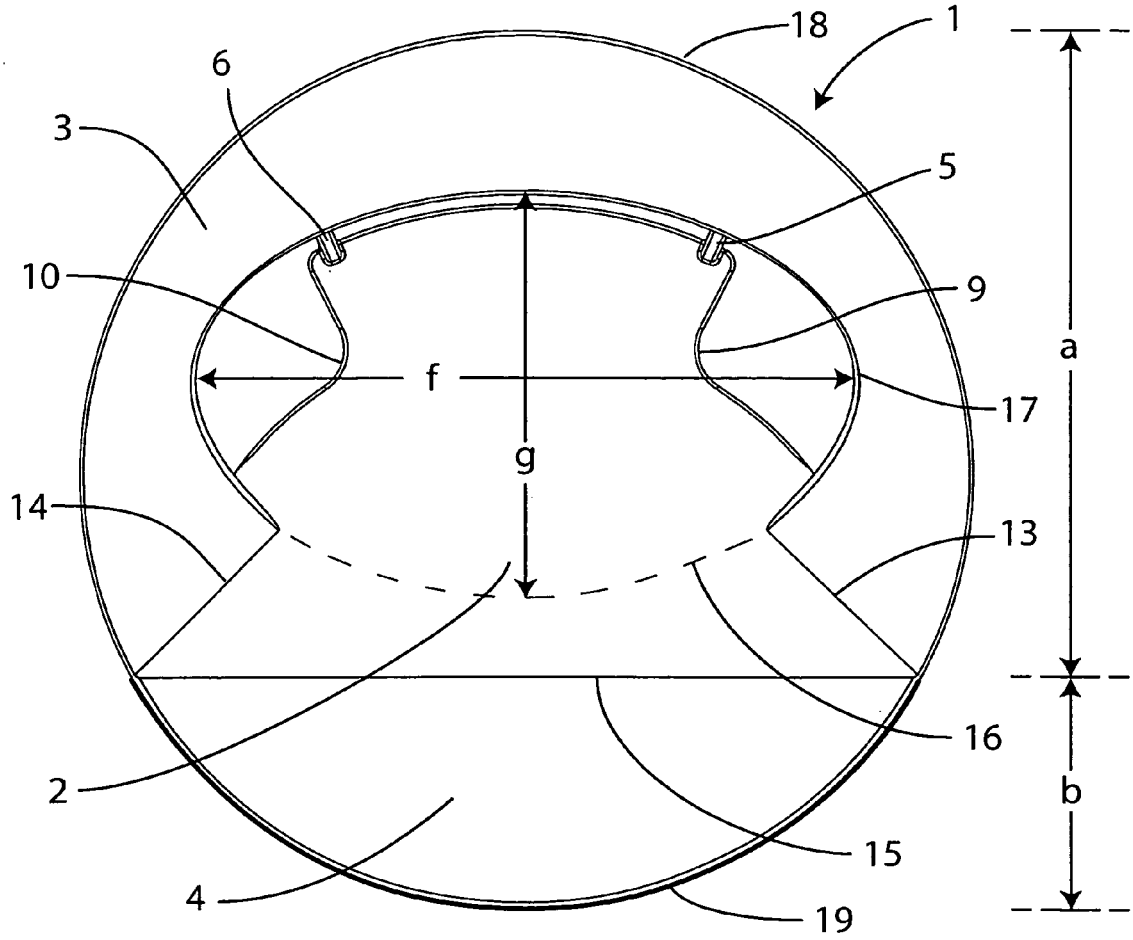
FIG. 3 shows a top plan view of the chair shown in FIG. 1.

In a preferred embodiment, secondary seating surface 3 is bounded by an inner circumferential edge 17 and an outer circumferential edge 18, where the inner circumferential edge 17 approximates a section of an ellipse having major axis dimension f and minor axis dimension g. The ratio of the major axis f to the minor 11 axis g should preferably be greater than one (1) and less than three (3). As shown in FIG. 3, dotted line 16 represents the missing portion of the ellipse not actually completed by inner circumferential edge 17. This dotted line 16 is not representative of any actual piece of the chair, and is shown only to provide a reference end point for minor axis dimension g.

While preferably circular or elliptical, the shape of outer circumferential edge 18 may be determined by aesthetic considerations, given that the minimum distance between inner circumferential edge 17 and outer circumferential edge 18 is sufficient to provide comfort and support. In a preferred embodiment, the minimum distance between inner circumferential edge 17 and outer circumferential edge 18 is at least 0.5".

Preferably, supports 5, 6 anchor the secondary seating surface 3 to the primary seating surface 2 and rear legs 7, 8. Depending on the material of manufacture, these supports 5, 6 may be omitted, creating a cantilevered secondary seating surface 3. Additional legs 11, 12 provide support for the primary seating surface 2. Alternatively, supports 5, 6 and rear legs 7, 8 may be formed in a single structure.

In an alternative embodiment, additional legs 11, 12 and rear legs 7, 8 may comprise different configurations or heights. For example, legs 7, 8, 11, 12 may be extendable via the attachment of separate extension legs, or via a telescoping mechanism. In addition, legs 7, 8 and legs 11, 12 may comprise a single element having a large base surface in order to reduce the pressure exerted onto the ground so that chair 1 does not sink into soft ground or damage finely finished floors. Further, legs 7, 8, 11, 12 may be foldable or collapsible such that they fold into the plane of primary seating surface 2 or tertiary seating surface 4. Additionally, legs 7, 8, 11, 12 may comprise different shapes, such as arch-shaped, cylindrical, rectangular, tapered, etc.

In cantilevered embodiments, where supports 5, 6 (or equivalent) are not present, the shape of outer circumferential edge 18 may be partially determined by the desired stiffness of cantilevered secondary seating support 3. The cantilever spring rate may be chosen to provide some self-adjustment under the load provided by the portion of a seated user's weight being supported on secondary seating surface 3.

Figure 4:
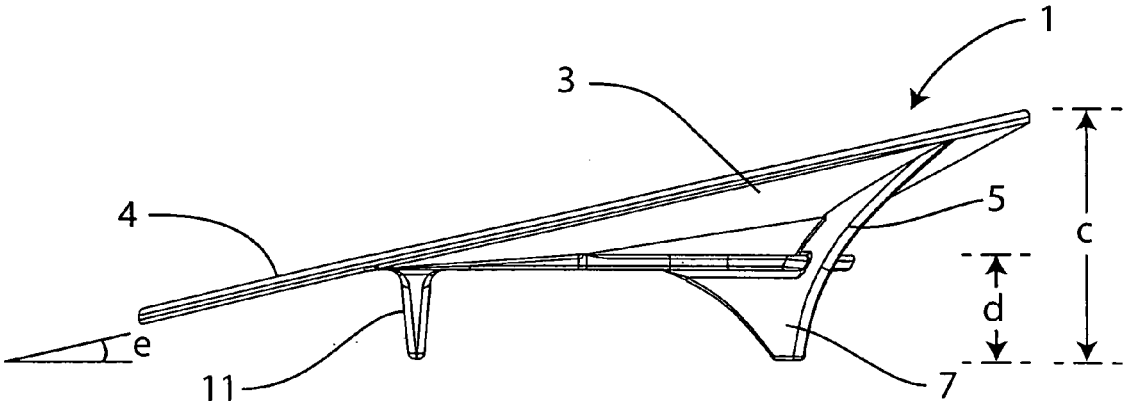
FIG. 4 shows a right side view of the chair shown in FIG. 1.
Figure 5:
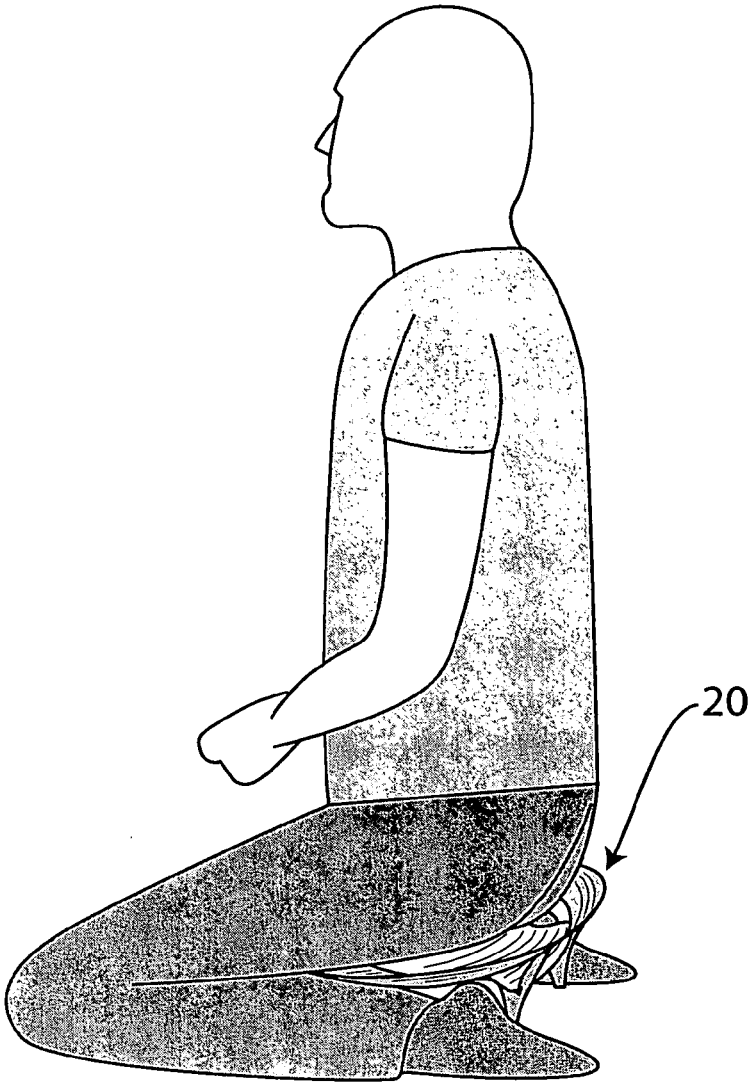
FIG. 5 shows a side perspective view of the chair shown in FIGS. 1–4 as used in the seiza position.
Figure 6:
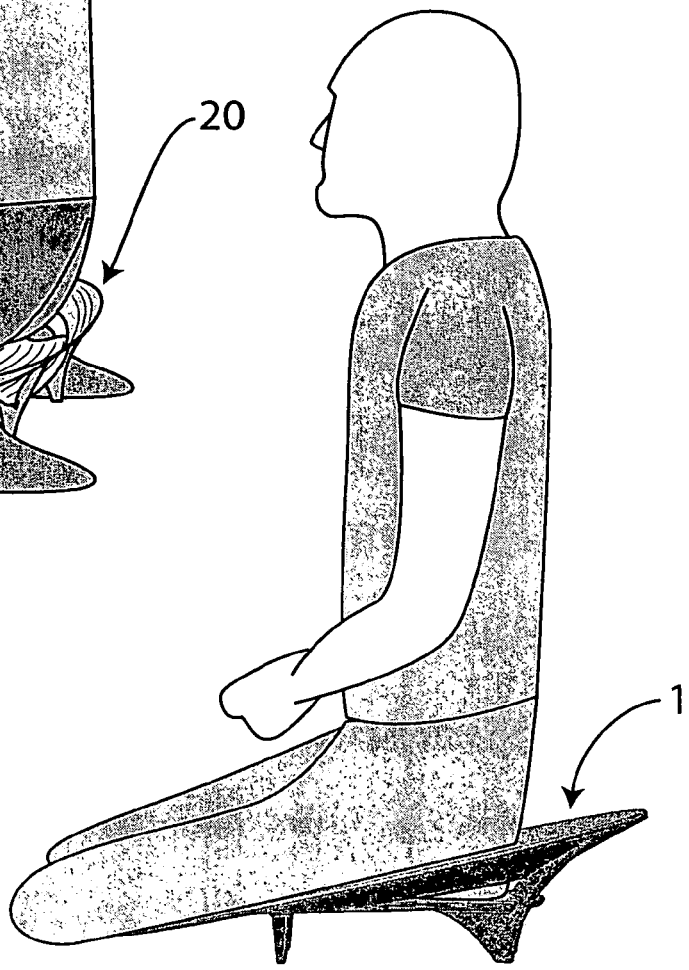
FIG. 6 shows a side perspective view of the chair shown in FIGS. 1–4 as used in the lotus position.

Referring again to the preferred embodiment of the present invention depicted in FIGS. 3 and 4, a tertiary seating surface 4 slopes downward and away from the front of primary seating surface 2, allowing the user's legs to comfortably extend away from the buttocks (which are located on the primary seating surface as shown in FIGS. 5 and 6), down to the floor, ground or other seating level. This sloped transition 4 between the primary seating surface 2 and the front edge of the chair gradually provides transitional support to a user's legs at the front edge of the chair 1, thereby reducing restriction of blood flow and lymph fluid flow in the legs of the user when seated for an extended period of time. Furthermore, while FIG. 4 depicts tertiary seating surface 4 in alignment with cantilevered secondary seating surface 3, this is not necessary. That is, chair 1 may be configured such that tertiary seating surface 4 is at some angle with respect to cantilevered secondary seating surface 3.

When used at a sufficient seat height, the rounded cutouts 9, 10 from the rear sides of the primary seating surface 2 allow the user to tuck his or her heels under his or her buttocks as in the tucked seating position. Cutouts 9, 10 in conjunction with the raised height of the primary seating surface allow the user to sit comfortably with little or no weight exerted upon the heels by the buttocks while seated in the tucked position.

Further, chair 1 may be collapsible such that secondary seating surface 3 and tertiary seating surface 4 may be planar with respect to each other such that angle e is approximately zero. For example, secondary seating surface 3 and tertiary seating surface 4 may be connected to primary seating surface 2 via a hinge mechanism such that the seating surfaces become approximately co-planar. In addition, chair 1 may be configured such that legs 7, 8, 11, 12 may also be folded or collapsed into the plane of primary seating surface 2.

The preferred embodiment described above comprises a chair as being made of multiple parts. However, an alternate embodiment of the present invention may comprise a single composite piece that may be manufactured through any known process, such as injection molding.

KEY TO CALLED OUT FEATURES

1 Chair configuration at low height
2 Primary seating surface, roughly parallel to ground
3 Secondary seating surface, inner and outer circumferential edges are individually planar with a sloping surface connecting the two
4 Tertiary seating surface
5 Support, connecting 3 to 2
6 Support, connecting 3 to 2
7 Rear, right leg
8 Rear, left leg
9 Right heel cutout
10 Left heel cutout
11 Front, right leg
12 Front, left leg
13 Line segment interface between 2 and 3, right
14 Line segment interface between 2 and 3, left
15 Line segment interface between 3 and 4
16 Approximated ellipse
17 Inner circumferential edge of 3
18 Outer circumferential edge of 3
19 Frontal edge of 4
20 Chair configuration at higher height, sufficient for lower leg clearance beneath buttocks Referring back to FIGS. 3 and 4, by way of example, a chair made in accordance with the preferred embodiment of the present invention as set forth herein may have the following dimensions and/or angles: (a) is 11 inches; (b) is 4 inches; (c) is 4.25 inches; (d) is 1.75 inches; (e) is 12.8 degrees; (f) is 11 inches; and (g) is 6.5 inches. Of course, any or all of these sample dimensions and/or angles may be varied to create a chair of a different height, width, depth, overall size, seating size and/or shape, etc. These may be varied for any number of reasons, including but not limited to the size of the intended user.

In yet another alternative embodiment of the present invention, a means for attaching a cushion or sponge pad may be included on primary seating surface 2 and/or secondary seating surface 3. Such a cushion may be secured in place through various means, such as glue, staples, nails, sewing, etc. or may be removably attached with VELCRO™ or other similar hook and loop-type fastener devices or other non-permanent attachment means.

The foregoing detailed description has been given for clearness of understanding only, and no unnecessary limitation should be understood therefrom. While the present invention has been described with reference to the preferred embodiment and several alternative embodiments, which embodiments have been set forth in considerable detail for the purposes of making a complete disclosure of the invention, such embodiments are merely exemplary and are not intended to be limiting or represent an exhaustive enumeration of all aspects of the invention. The scope of the invention, therefore, shall be defined solely by the following claims. Further, it will be apparent to those of skill in the art that numerous changes may be made in such details without departing from the spirit and the principles of the invention. It should be appreciated that the present invention is capable of being embodied in other forms without departing from its essential characteristics.

What is claimed is:

1. An apparatus for providing supportive sitting at levels near or slightly above the ground or other seating level, wherein said apparatus comprises:

first and second integrally formed seating elements, said first seating element comprising a first seating surface, said second seating element comprising a second seating surface positioned above, around and at an angle relative to said first seating surface, and at least one support structure for supporting said first and second seating elements above said seating level, wherein said second seating element comprises a generally ring-like structure including outer and inner circumferential edges, wherein said second seating surface is angled downward from said outer edge to said inner edge, wherein said second seating surface adjoins said first seating surface along left and right linear joining segments intersecting the left side of the forward edge of said first seating surface, and the right side of said first seating surface, wherein said first seating surface lies approximately in a first plane and said second seating surface slopes downward toward the center of said chair, such that said inner circumferential edge lies approximately in a second plane and said outer circumferential edge lies approximately in a third plane, wherein said second and first planes intersect along a line parallel to a plane of a forward sloped portion of said first seating element, wherein said third and first planes intersect along a line parallel to said plane of said forward sloped portion of said first seating element, wherein said line of intersection of said third and first planes is forward of said line of intersection of said second and first planes, and wherein an angle formed between said first and second planes is smaller than an angle formed between said first and third planes.

2. The apparatus of claim 1, wherein said support structures are shaped to provide distributed support of said first seating surface.

3. The apparatus of claim 2, wherein at least one of said support structures intersects a back edge of said first seating surface and further connects said first seating surface to said second seating surface.

4. The apparatus of claim 2, wherein said at least one support structure supports said first seating element above said seating level at a distance in the range of approximately 1 to 4 inches.

5. The apparatus of claim 1, wherein said left and right linear joining segments lie on lines which intersect near the center of said first seating surface.

6. The apparatus of claim 1, wherein said outer circumferential edge and a front edge of said first seating element approximately comprise contiguous segments of a complete circle.

7. A chair comprising:

a first seating platform approximately parallel to a seating level, said first seating platform comprising a forward edge, a back edge, a left side and a right side;

a second seating platform surrounding said first seating platform, said secondary seating platform comprising an outer circumferential edge and an inner circumferential edge, said inner circumferential edge comprising an approximately elliptical section, and said second seating platform angled down and forward with respect to said first seating platform, wherein said second seating platform adjoins said first seating platform along left and right linear joining segments intersecting the left side of said forward edge and the right side of said forward edge, respectively;

a third seating platform adjoining said first seating platform along said forward edge, said third seating platform having a left side, a right side, a back edge, and a front edge, said back edge of said third seating platform adjoining said forward edge, and said third seating platform angled down and forward of said first seating platform; and a support structure serving to elevate said first seating platform above the ground.

8. The chair of claim 7, wherein said support structure supports said primary seating surface at a sufficient height to allow a user's heels to tuck under the left and right sides of said secondary seating surface when a user sits in seiza position, and said left and right sides of said primary seating surface are cut to allow the heels of a user seated in a seiza position to fit under said secondary seating surface.

9. The chair of claim 7, wherein said support structure comprises at least three legs, said legs configured to provide distributed support of said first seating platform.

10. The chair of claim 9, wherein at least one of said legs intersects the back edge of said first seating platform, and wherein said leg further connects said first seating platform rigidly to said second seating platform.

11. The chair of claim 9, wherein said legs support said first seating platform above said seating level at a distance in the range of approximately 1 to 4 inches.

12. The chair of claim 7, wherein said left and right linear joining segments lie on lines which intersect near the center of said first seating platform.

13. The chair of claim 7, wherein said first seating platform lies approximately in a first plane and said second seating platform slopes downward toward the center of said chair, such that said inner circumferential edge lies approximately in a second plane and said outer circumferential edge lies approximately in a third plane, wherein:

said second and first planes intersect along a line parallel to a plane of said forward edge of said first seating platform;

said third and first planes intersect along a line parallel to said plane of said forward edge of said first seating platform;

said line of intersection of said third and first planes is forward of said line of intersection of said second and first planes; and an angle formed between said first and second planes is smaller than an angle formed between said first and third planes.

14. The chair of claim 7, wherein said outer circumferential edge and said front edge of said third seating platform approximately comprise contiguous segments of a complete circle.

15. The chair of claim 7, wherein said second seating platform is configured to serve as a carrying element.

* * * * *